US008540496B2

(12) United States Patent
Suzuki et al.

(10) Patent No.: US 8,540,496 B2
(45) Date of Patent: Sep. 24, 2013

(54) FAN APPARATUS

(75) Inventors: Yuzuru Suzuki, Nagano-ken (JP); Yuuki Takahashi, Nagano-ken (JP); Yoshiki Sakamoto, Nagano-ken (JP)

(73) Assignee: Minebea Co., Ltd., Nagano-Ken (JP)

( * ) Notice: Subject to any disclaimer, the term of this patent is extended or adjusted under 35 U.S.C. 154(b) by 366 days.

(21) Appl. No.: 12/708,738

(22) Filed: Feb. 19, 2010

(65) Prior Publication Data

US 2010/0215527 A1 Aug. 26, 2010

(30) Foreign Application Priority Data

Feb. 25, 2009 (JP) ..... 2009-041856

(51) Int. Cl.
*F04B 35/04* (2006.01)

(52) U.S. Cl.
USPC ..... 417/423.14

(58) Field of Classification Search
USPC ..... 417/423.1, 423.14, 423.8, 354, 366, 417/367; 415/220; 310/64, 67 R, 58; 361/395
See application file for complete search history.

(56) References Cited

U.S. PATENT DOCUMENTS 4,692,091 A * 9/1987 Ritenour ..... 415/119
7,042,121 B2 * 5/2006 De Filippis et al. ..... 310/63
7,175,399 B2 2/2007 Matsumoto et al.
7,259,486 B2 8/2007 Yamamoto
7,300,262 B2 * 11/2007 Ku et al. ..... 417/366
7,390,172 B2 * 6/2008 Winkler ..... 417/423.15
7,800,263 B2 * 9/2010 Horng et al. ..... 310/67 R
2002/0187058 A1 * 12/2002 Lee ..... 417/366
2004/0136842 A1 * 7/2004 Obara et al. ..... 417/354
2006/0220475 A1 * 10/2006 Goto et al. ..... 310/49 R
2006/0285982 A1 * 12/2006 Lin et al. ..... 417/354
2008/0157633 A1 * 7/2008 Yang et al. ..... 310/67 R
2008/0219841 A1 * 9/2008 Carl et al. ..... 415/208.1

FOREIGN PATENT DOCUMENTS

JP 2004-36569 2/2004
JP 2006-322451 11/2006

* cited by examiner

*Primary Examiner* — Devon Kramer
*Assistant Examiner* — Amene Bayou
(74) *Attorney, Agent, or Firm* — Fay Sharpe LLP

(57) ABSTRACT

A fan apparatus is provided and includes: a housing having a hollow cylindrical shape; a circuit board holding structure which is disposed in the housing so as to be located at the radially central part of the housing and which includes a plurality of slits extending axially; a circuit board disposed inside the circuit board holding structure in parallel with the axial direction; a plurality of fixed blades disposed so as to bridge between the housing and the circuit board holding structure; and a motor which includes a rotary shaft and an impeller and which is disposed at the front end of the circuit board holding structure, wherein the impeller is connected to the rotary shaft so as to move air.

18 Claims, 3 Drawing Sheets

FAN APPARATUS

BACKGROUND OF THE INVENTION

1. Field of the Invention

The present invention relates to a fan apparatus, and specifically a small fan apparatus for blowing out heat which is generated inside a chassis of an electronic equipment.

2. Description of the Related Art

In an office automation (OA) equipment such as a personal computer or a copier, many electronic parts are housed in a chassis with a relatively small width. In such an OA equipment, heat generated from the above electronic parts stays in the chassis, thus possibly resulting in destroying the electronic parts. To prevent the problem, a vent hole is provided on the side wall or ceiling of the chassis and a fan is provided at the vent hole so as to blow out the heat generated in the chassis. Recently, in order to produce a large volume of air flow, a fan apparatus of series arrangement is used which is structured such that two axial-flow fans identical in outer shape and characteristics to each other are arranged axially in series (refer, for example, to Japanese Patent Application Laid-Open No. 2004-36569).

In order to securely provide a large volume of air flow while intending to downsize the fan apparatus, the motor of the axial-flow fan must be rotated in a high speed. To rotate the motor of the axial-flow fan in a high speed, a large current must be applied to the coil of the motor. Consequently, the coil increases its heat production resulting in increasing the amount of heat dissipated from the motor itself. At the same time, the amount of heat dissipated from the electronic parts is caused to increase which are mounted on the circuit board for driving the motor, and if the heat dissipated exceeds the operating temperature limit of the electronic parts, then the electronic parts may malfunction.

Under the circumstances described above, an axial-flow fan is proposed which blows out the heat generated by a motor rotating in a high speed (refer, for example, to Japanese Patent Application Laid-Open No. 2006-322451).

The fan apparatus of series arrangement disclosed in Japanese Patent Application Laid-Open No. 2004-36569 in which two axial-flow fans are arranged axially in series can securely provide a larger volume of air flow than a fan apparatus composed of one axial-flow fan, but two motors must be driven thus inevitably consuming more electricity. This does not comply with the demand for energy saving.

Also, in the axial-flow fan disclosed in Japanese Patent Application Laid-Open No. 2006-322451 in which a circuit board is attached on a plate which is fixed to the bottom surface of the case of a motor, the motor of the axial-flow fan must be downsized in accordance with downsizing of the fan apparatus. Consequently, the circuit board also must be downsized in accordance with reduction of the outer dimension of the motor of the axial-flow fan, but there exists a limitation due to a mounting layout of the electronic parts and therefore the circuit board cannot be downsized.

SUMMARY OF THE INVENTION

The present invention has been made in light of the above problems, and it is an object of the present invention to provide a small fan apparatus which enables an increased air flow volume and which has an excellent heat dissipation efficiency.

In order to achieve the above object, according to an aspect of the present invention, there is provided a fan apparatus which includes: a housing having a hollow cylindrical shape; a circuit board holding structure which is disposed inside the housing so as to be located at the radially central part of the housing and which includes a plurality of slits extending axially; a circuit board disposed inside the circuit board holding structure in parallel with the axial direction; a plurality of fixed blades disposed so as to bridge between the housing and the circuit board holding structure; and a motor which includes a rotary shaft and an impeller and which is disposed at the front end of the circuit board holding structure, wherein the impeller is connected to the rotary shaft so as to move air.

In the aspect of the present invention, the housing, the fixed blades and the circuit board holding structure may be integrally formed.

In the aspect of the present invention, the circuit board holding structure may include a guide member disposed on the inner surface thereof, and the circuit board may be inserted along the guide member.

In the aspect of the present invention, the fan apparatus may further include a presser bar spring configured to retain the circuit board inside the circuit board holding structure.

In the aspect of the present invention, the fan apparatus may further include a cover and locking claws disposed at the rear end of the circuit board holding structure, wherein the cover is engagingly secured by the locking claws to the rear end of the circuit boarding holding structure.

In the aspect of the present invention, a plurality of vent holes having a diameter of 2 mm or less may be provided on the cover.

According to the present invention, a small fan apparatus can be provided which has excellent heat dissipation efficiency and enables the air volume to increase.

Also, according to the present invention, since the circuit board on which the electronic parts are mounted is disposed in parallel with the axial direction at the same time the circuit board are housed inside the circuit board holding structure, the fan apparatus can be downsized regardless of the dimension of the surface mount area without hindering the air flow.

DETAILED DESCRIPTION OF THE PREFERRED EMBODIMENTS

An exemplary embodiment of the present invention will be described hereinafter with reference to the accompanying drawings.

Figure 1:
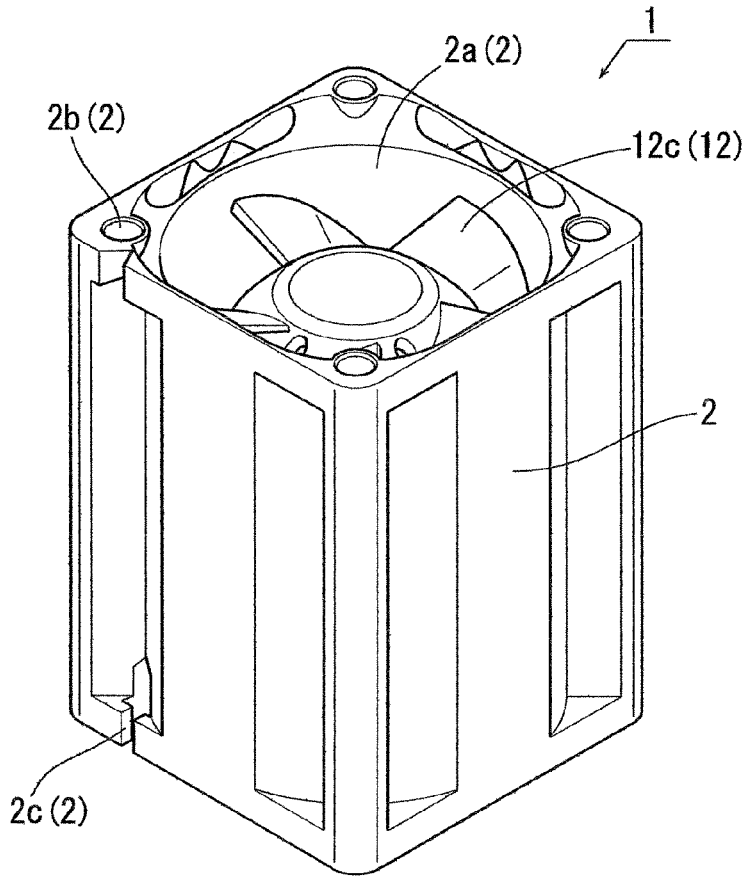
FIG. 1 is a perspective view of a fan apparatus according to an embodiment of the present invention.
Figure 2:
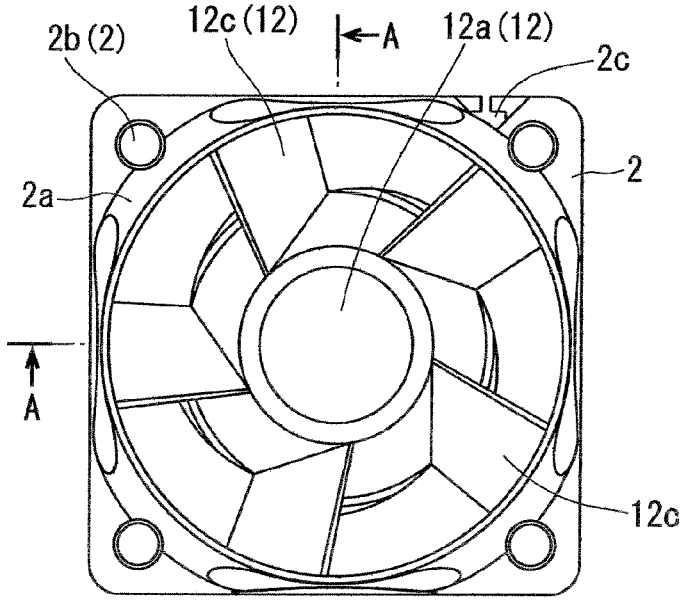
FIG. 2 is a top plan view of the fan apparatus of FIG. 1.
Figure 3:
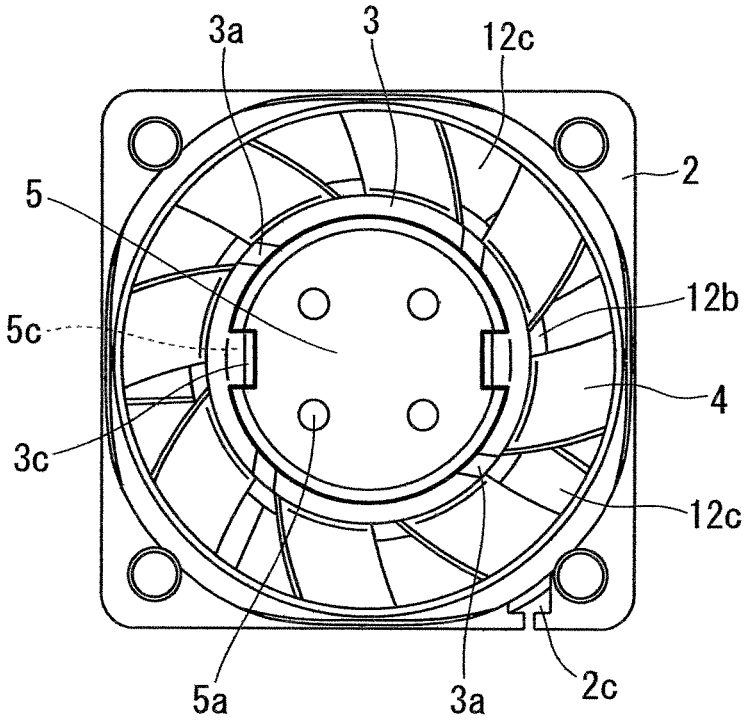
FIG. 3 is a bottom plan view of the fan apparatus of FIG. 1.
Figure 4:
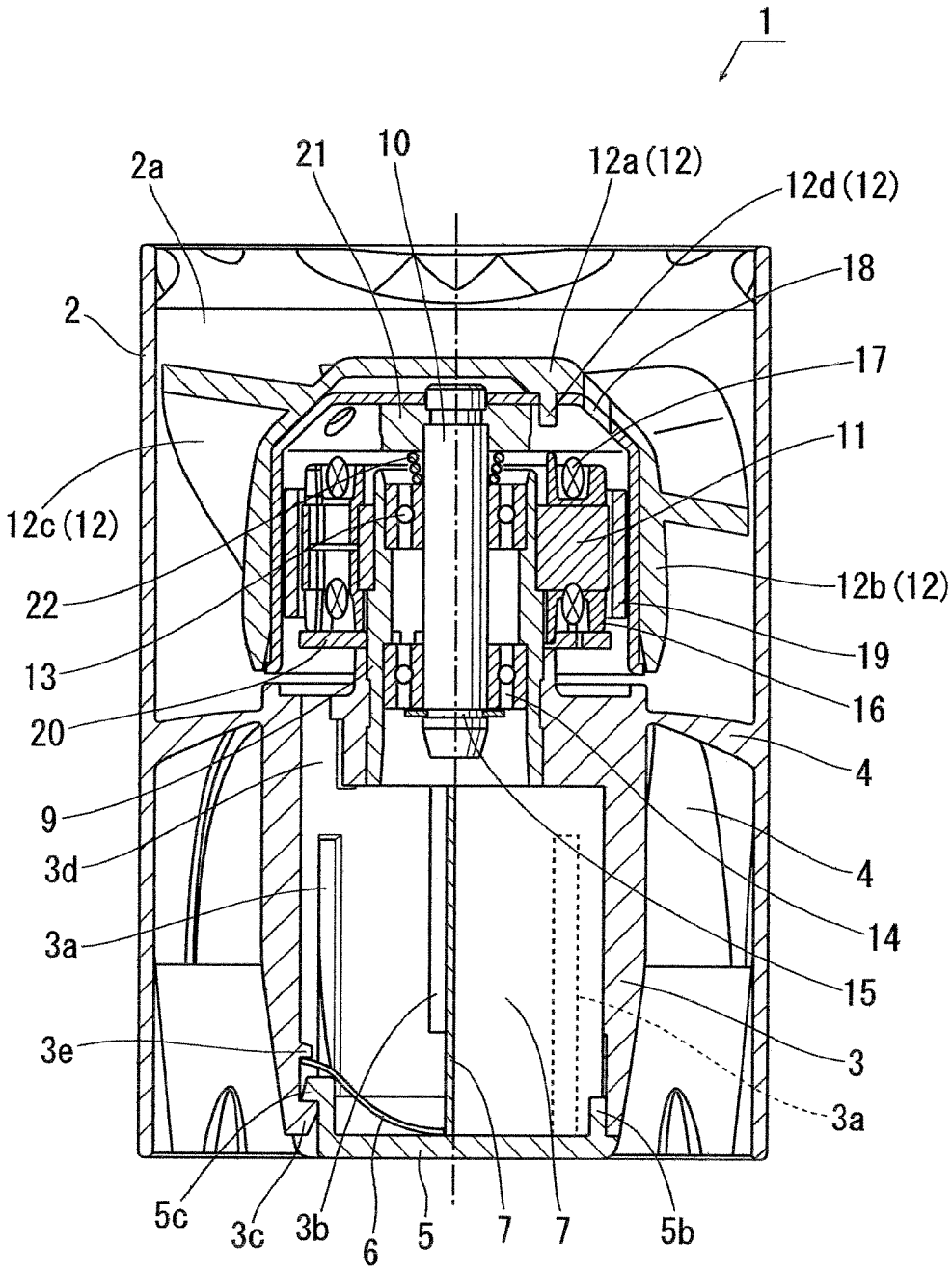
FIG. 4 is a cross sectional view of the fan apparatus taken from line A-A in FIG. 2.

FIG. 1 shows perspectively a fan apparatus 1 according to an embodiment of the present invention, FIGS. 2 and 3 show the fan apparatus 1 of FIG. 1 viewed from the top and bottom, respectively, and FIG. 4 shows a cross section of the fan apparatus 1 of FIG. 1 taken from line A-A in FIG. 2.

The fan apparatus 1 includes a housing 2 which, in its appearance, has a rectangular cylindrical shape with a square cross section orthogonal to the rotation axis, wherein a draft hole 2*a* having a substantially circular cross section is formed axially through the radially central part of the housing 2, and a through hole 2*b* for attaching the fan apparatus 1 to a chassis of an electronic equipment (not shown) is disposed at each of four corners of the square cross section of the housing 2. In the present embodiment, the housing 2 has a square side of 40 mm and an axial length of about 56 mm. A notch 2*c* is disposed at an air outlet end (hereinafter referred to as "rear end") of the housing 2 so as to hook power supply wires for a circuit board 7.

The housing 2 is not limited in appearance to a rectangular cylindrical shape but may alternatively be shaped circular cylindrical.

A circuit board holding structure 3 is fixedly retained at the radially central part of the draft hole 2*a* of the housing 2 by a plurality (eight in FIG. 3) of fixed blades 4. The fixed blades 4 are disposed at the outer circumferential surface of the circuit board holding structure 3 and at the same time connected to the housing 2. The housing 2, the circuit board holding structure 3 and the fixed blades 4 are made of common resin material (synthetic resin, such as PBT or ABS) and integrally formed by injection molding. The fixed blades 4 are equiangularly arranged on the outer circumferential surface of the circuit board holding structure 3, and are optimally curved.

A cover 5 is attached at a rear end of the circuit board holding structure 3 to thereby prevent the intrusion of foreign substances such as dusts thereinto.

A plurality (four in FIG. 3) of slits 3*a* extending axially are equiangularly formed at the circumferential wall of the circuit board holding structure 3. Through the slits 3*a*, the space inside the circuit board holding structure 3 and the outer space communicate with each other.

Two guide grooves 3*b* for positioning the circuit board 7 on which the electronic parts for driving the fan apparatus 1 are mounted are formed on the inner circumferential surface of the circuit board holding structure 3. By inserting the circuit board 7 along the guide grooves 3*b*, the circuit board 7 is readily positioned and held in place inside the circuit board holding structure 3. After placing the circuit board 7 in place inside the circuit board holding structure 3, a presser bar spring 6 is put inside the circuit board holding structure 3 and attached to a hook 3*e* which is formed inside the circuit board holding structure 3. The presser bar spring 6 presses one end of the circuit board 7 and thus the circuit board 7 is securely held in place inside the circuit board holding structure 3. Also, the circuit board 7 is disposed inside the circuit board holding structure 3 so as to be oriented in parallel with the axial direction thereby not hindering the air flow, and at the same time the fan apparatus 1 can be downsized regardless of the dimension (the surface mount area of the circuit elements) of the circuit board 7.

A plurality of locking claws 3*c* are formed at the rear end of the circuit board holding structure 3. By setting bosses 5*b* of the cover 5 to the rear end portion of the circuit board holding structure 3, the locking claws 3*c* are engaged with step portions 5*c* of the cover 5 and thereby the cover 5 is engagingly held to the rear end of the circuit board holding structure 3. And, a plurality of vent holes 5*a* with a diameter of 2 mm or less are formed on the cover 5.

A fan motor 8 is disposed at the other end (front end) of the circuit board holding structure 3. The fan motor 8 includes a circular cylindrical bearing holder 9, a rotary shaft 10, a stator core 11 and an impeller 12.

The bearing holder 9 is fixedly attached at the radially central part of the circuit board holding structure 3. Two bearings 13 and 14 are retained inside the bearing holder 9 with a space therebetween. The rotary shaft 10 is disposed through the bearings 13 and 14 and rotatably retained by the bearings 13 and 14. A C-shape stopper ring 15 is attached to one end of the rotary shaft 10 thereby preventing the dropout of the rotary shaft 10 and also positioning the rotary shaft 10 with respect to the axial direction.

The stator core 11 includes a plurality of core plates stacked on one another and is disposed around the bearing holder 9. An insulator 16 is attached to the stator core 11, and a coil 17 is wound around the insulator 16 at each of arms of the stator core 11.

The impeller 12 includes an impeller body 12*a* having a circular cylindrical portion 12*b*. A plurality (five in the figures) of rotary blades 12*c* are equiangularly disposed on the outer circumferential surface of the impeller body 12*a* in the rotating direction. The rotary blades 12*c* have a wing shape defining a front edge and a rear edge and also have a unique curvature so as to catch and guide the inflowing air or other fluids. A cylindrical cup-shaped back yoke 18 is snapped into the circular cylindrical portion 12*b* of the impeller 12. To attach the impeller 12 to the back yoke 18, a boss 12*d* integrally formed at an inner surface of the impeller body 12*a* is inserted into a hole formed at the cup base portion of the back yoke 18. A circular cylindrical permanent magnet 19 is disposed on the inner circumferential surface of the back yoke 18. A hollow boss portion 21 made by aluminum die casting is disposed at the radially central part of the cup base portion of the back yoke 18 and the other end of the rotary shaft 10 is fixedly fitted in the hollow of the boss portion 21 whereby the rotary shaft 10 is fixedly connected to the back yoke 18. The impeller 12 is thus fixedly connected to the other end of the rotary shaft 10, and the rotary blades 12*c* are adapted to rotate around the axis of the rotary shaft 10 in accordance with the rotation of the rotary shaft 10. A preload spring (coil spring) 22 to pressurize the bearing 13 is interposed between the boss portion 21 and the inner ring of the bearing 13.

The impeller 12 is integrally made of a common resin material (synthetic resin, such as PBT or ABS) by injection molding. The ratio of the axial length between the rotary blades 12*c* and the fixed blades 4 is set to about 1 to 1 thereby straightening the air flow with a minimal length. Moreover, if the distance from the air inlet end (front end) of the housing 2 to the rotary blades 12*c* of the impeller 12 is short, the middle range of the air pressure P—volume Q characteristics as fan characteristics is caused to deteriorate. Therefore, it is preferable to set the distance to 5 mm or more.

The fan motor 8 and the circuit board 7 are electrically connected to each other via a flexible printed circuit (FPC) (not shown). One end of the FPC is connected to a PCB board 20 to which ends of the coils 17 of the fan motor 8 are connected, and the other end of the FPC is connected to the circuit board 7 via a through hole 3*d* formed on the front end of the circuit board holding structure 3.

The operation of air blowing will now be described.

When a direct current with a predetermined voltage is supplied to the fan apparatus 1, the fan motor 8 is driven whereby the impeller 12 is rotated. Then, the air in the chassis of the electronic equipment is sucked into the draft hole 2*a* and blown toward the fixed blades 4.

The air blown to the fixed blades 4 is guided along the fixed blades 4, passes between adjacent fixed blades 4 and exits from the rear end of the housing 2. Thus, the air in the chassis of the electronic equipment is blown out from the chassis. According to the air blowing operation described above, it is cooled inside the chassis of the electronic equipment. In this operation, the air guided along the fixed blades 4, when passing through the vicinity of the slits 3*a* formed at the circumferential wall of the circuit board holding structure 3, is partly introduced into the circuit board holding structure 3 through the slits 3*a* and exits from the vent holes 5*a* which are formed on the cover 5. Accordingly, the heat generated by the circuit board 7 and staying inside the circuit board holding structure 3 is dissipated outside the circuit board holding structure 3 by means of an air flow generated by the air introduced through the slits 3*a* into the circuit board holding structure 3 and blowing through there resulting in efficiently dissipating the heat out of the circuit board holding structure 3 and cooling the space thereinside, thus preventing the electronic parts mounted on the circuit board 7 from malfunctioning due to heat.

What is claimed is:

1. A fan apparatus comprising:

a housing having a hollow tubular shape;

a circuit board holding structure centrally disposed inside the housing and comprising axially extending slits for communicating an interior of the circuit board holding structure with an exterior of the circuit board holding structure;

a plurality of fixed blades disposed between the housing and the circuit board holding structure, the plurality of fixed blades being fixed to the housing and the circuit board holding structure for guiding air through the slits;

a motor comprising a rotary shaft, a stator and an impeller having a plurality of rotary blades, the motor being disposed at a front end of the circuit board holding structure;

a circuit board with electronic parts mounted thereon is disposed in the interior of the circuit board holding structure, wherein a surface of the circuit board with the electronic parts mounted thereon is arranged in parallel with an axial direction of the motor; and a cover and locking claws disposed at a rear end of the circuit board holding structure, wherein the cover is engagingly secured by the locking claws to the rear end of the circuit board holding structure wherein a plurality of vent holes are provided on the cover attached to the end of the circuit board holding structure.

2. A fan apparatus according to claim 1, wherein the housing, the fixed blades and the circuit board holding structure are integrally formed.

3. A fan apparatus according to claim 1, wherein the circuit board holding structure comprises a guide member disposed on an inner surface thereof, and the circuit board is inserted along the guide member.

4. A fan apparatus according to claim 1, further comprising a presser bar spring configured to retain the circuit board inside the circuit board holding structure.

5. A fan apparatus according to claim 1, wherein the housing is of a rectangular shape.

6. A fan apparatus according to claim 1, wherein the housing is of a circular shape.

7. A fan apparatus comprising:

a housing;

a circuit board holding structure disposed inside the housing and comprising a wall and axially extending slits located on the wall for communicating an interior of the circuit board holding structure with an exterior of the circuit board holding structure;

a plurality of fixed blades connecting the housing and the circuit board holding structure, the plurality of fixed blades guiding air through the slits;

a motor comprising a rotary shaft, a stator and an impeller including a plurality of rotary blades, the motor being disposed at a first end of the circuit board holding structure;

a circuit board with electronic parts mounted thereon disposed in the interior of the circuit board holding structure, wherein a surface of the circuit board with electronic parts mounted thereon is arranged parallel with an axial direction of the motor; and a cover mounted to a second end of the circuit board holding structure wherein a plurality of vent holes are provided in the cover.

8. A fan apparatus according to claim 7, wherein the plurality of fixed blades are equiangularly arranged on an outer circumferential surface of the circuit board holding structure.

9. A fan apparatus according to claim 7, wherein the plurality of fixed blades are curved.

10. A fan apparatus according to claim 7, further comprising at least one guide groove formed on an inner surface of the circuit board holding structure for mounting the circuit board in the circuit board holding structure.

11. A fan apparatus according to claim 7, further comprising a presser bar spring for securing the circuit board in the circuit board holding structure.

12. A fan apparatus according to claim 7, further comprising a plurality of locking claws provided on one of the cover and the circuit board holding structure for mounting the cover to the circuit board holding structure.

13. A fan apparatus according to claim 7, further comprising a stopper ring attached to the rotary shaft for positioning the rotary shaft with respect to the axial direction of the motor.

14. A fan apparatus according to claim 7, wherein the plurality of rotary blades has a wing shape and a curvature that is adapted to guide inflowing air.

15. A fan apparatus according to claim 7, wherein a ratio of an axial length between the plurality of rotary blades and the plurality of fixed blades is approximately 1:1.

16. A fan apparatus according to claim 7, wherein the housing is one of a rectangular and circular shape.

17. A fan apparatus according to claim 7, wherein the housing, the fixed blades and the circuit board holding structure are integrally formed.

18. A fan apparatus according to claim 7, wherein the circuit board holding structure is centrally disposed inside the housing.

* * * * *